US008695245B2

(12) United States Patent
Schorre

(10) Patent No.: US 8,695,245 B2
(45) Date of Patent: Apr. 15, 2014

(54) WING SHAPED BEVERAGE CAN PULL TAB

(76) Inventor: Christopher P. Schorre, Austin, TX (US)

( * ) Notice: Subject to any disclaimer, the term of this patent is extended or adjusted under 35 U.S.C. 154(b) by 10 days.

(21) Appl. No.: 13/305,097

(22) Filed: Nov. 28, 2011

(65) Prior Publication Data

US 2013/0134065 A1 May 30, 2013

(51) Int. Cl.
*G09F 3/02* (2006.01)

(52) U.S. Cl.
USPC ..... 40/307; 220/269; 220/272; D9/438

(58) Field of Classification Search
USPC ..... 40/307; 220/269; D8/438
See application file for complete search history.

(56) References Cited

U.S. PATENT DOCUMENTS

| | | | | |
|---|---|---|---|---|
| 3,822,496 | A * | 7/1974 | Minder | 40/307 |
| 5,316,166 | A * | 5/1994 | Pavely et al. | 220/269 |
| 5,799,815 | A * | 9/1998 | Lang | 220/258.5 |
| D474,967 | S * | 5/2003 | Kaneko | D9/438 |
| 2005/0045637 | A1* | 3/2005 | Rohr et al. | 220/269 |
| 2005/0258175 | A1* | 11/2005 | Robertson | 220/269 |
| 2006/0196875 | A1* | 9/2006 | Cherian | 220/269 |
| 2010/0193519 | A1 | 8/2010 | Forrest | |
| 2012/0273492 | A1* | 11/2012 | Werth et al. | 220/260 |

FOREIGN PATENT DOCUMENTS

| | | | |
|---|---|---|---|
| JP | 59 133441 | B1 | 9/1984 |
| JP | 3 014455 | B1 | 1/1991 |

OTHER PUBLICATIONS

ISR/WO for related PCT/IB2012/056729, mailed on Mar. 13, 2013.

* cited by examiner

*Primary Examiner* — Joanne Silbermann
*Assistant Examiner* — Shin Kim
(74) *Attorney, Agent, or Firm* — Pierson IP, PLLC; Gene Pierson

(57) ABSTRACT

A wing shaped beverage can pull tab that is wide and tall enough to accommodate advertisements, logos, slogans, contest announcements, graphics, website addresses, etchings, or other marketing, promotional or informational messages targeting the consumer of the beverage. The wing shaped can pull tab can be detached from the can and stored in a pocket without causing injury because of its smooth round edges and compactness. The wing shaped can pull tab is large enough that it does not fall into the can when detached and create injury or choking hazard. The wing shaped can pull tab has a U shaped lift end that accommodates the insertion of a finger to lift the tab to actuate the opening of a can more easily. The contoured U shaped lift end of the wing shaped can pull tab also accommodates the septum of the nose to allow consumption of the beverage from the can without having to tilt the head too far back.

20 Claims, 3 Drawing Sheets

WING SHAPED BEVERAGE CAN PULL TAB

FIELD OF THE INVENTION

The present invention generally relates to pull tabs on beverage containers. More particularly, the invention relates to a wide format can pull tab with "wings" wide enough to accommodate marketing messages or logos on both its upper and lower surfaces.

BACKGROUND OF THE INVENTION

The use of pull tabs on containers of various kinds, particularly, beverage cans is well known in the art. The earliest beverage can pull tabs were of the type that detached from the can end when actuated and had to be discarded before imbibing the contents of the can. There were multiple problems associated with these ring tabs as they were predominantly known and described in U.S. Pat. No. 3,349,949 to Cudzik. The rings tabs once detached from the can had a tendency to fall back into the can after detachment creating a potential choking and injury hazard to the person drinking the contents of the can. In addition, the detached tabs when discarded on the ground could cause severe cuts to a person stepping on the sharp edges of the tab.

The pull out ring tabs were subsequently replaced by the stay on pull tabs which were constructed to stay attached to the can end after actuation to avoid the hazards associated with the detachable ring tabs. An example of such a stay on pull tab is described in U.S. Pat. No. 3,967,752. The stay on pull tabs on beverage and other cans in the market today generally have the same design and construction with minor variations. A majority of them have an elongated, rectangular shape with curvilinear lift and nose ends with the nose end extending over the frangible can top seal which is broken by lifting the lift end and exerting downward pressure on the seal through the nose end. A central fastening tongue and hinge at the nose end allows for the securement of the pull tab to the central rivet of the can. This central rivet acts as a fulcrum and lever providing the nose end of the pull tab sufficient downward pressure to break the frangible seal to open the can while at the same time allowing the tab to remain attached to the nose end of the can after the seal is broken.

Marketing of products by placing advertisements on the surfaces of a variety of objects, including beverage cans, apparel and other items has been in vogue for decades. Placing advertisements on articles and objects that are commonly used by the consumer has the potential to reach the maximum number of consumers and the related benefit of an uptick in sales for the advertised products. The worldwide popularity of beverages, both canned and bottled provides an excellent opportunity for marketing products through the strategic placement of advertisements on these beverage cans and bottles. However, the placement of advertisements and other promotional offers on the side of a can is not sufficiently noticeable and therefore of limited appeal to marketers.

Advertisements, promotions and logos printed on the underside of bottle caps have met with limited success primarily because the bottle caps are usually discarded as soon as they are removed from the bottle neck and scarce attention is paid to reading the printed material placed on the inside of the bottle cap. In addition, the sharp edges of the traditional bottle caps discourage their storage in a garment pocket. On the other hand, beverage can ends provide an ideal vehicle for marketing through placement of an advertisement, logo, and informational or promotional material on the pull tab itself, which is appealing to marketers as the consumer must look at the top of the can to actuate the pull tab, virtually guaranteeing exposure to the message on the pull tab A drawback with the current can pull tabs is their small shape and size which does not permit the placement of any meaningful printed, etched or cutout designs on them. The pull tab of the present invention through its unique wing-shaped design and construction overcomes the deficiency in the prior art for a can pull tab that is capable of providing a large enough surface area for the placement of advertisements, logos, or promotional offers and related material.

SUMMARY OF THE INVENTION

The present invention is a wide format wing shaped can pull tab. Through its unique design, structure and highly visible placement on the top of the can, the wing pull tab of the invention envisions the common utilitarian can pull tab as a vehicle and launching pad for meaningful promotion of consumer products by providing an expanded surface for placement of advertisements, logos, informational messaging and promotional material to reach the masses.

In an exemplary embodiment of the present invention, the can pull tab of the invention is a seamless wing shaped pull tab with a pair of wings on either side with their broadest sides spanning the top surface of the beverage can at one end of the can's circumference. In this embodiment of the invention, the broadest sides of the wing tab lies parallel to the outer rim of the can end but sufficiently inset from the can rim so it does not impede can stacking.

In the exemplary embodiment of the invention, a U shaped curved indent in the center between the two wings of the wing tab is raised a few millimeters from the surface of the can end to form the lift end of the wing tab with sufficient space to accommodate a forefinger or middle finger to lift the tab and minimizes the discomfort and broken nails experienced with the traditional can pull tabs. The subtle upward curvature of the indent on the lift end also eliminates the need for the use of a can opening device to open the can. An additional advantage of the curvature at the lift end of the tab is that when a person drinks directly from the can, the septum that separates the nostrils fits into the curvature and minimizes the angle at which a person must tilt their head backward to pour the beverage into their mouth. In this embodiment, the wing tab has a nose end that lies directly across from the lift end of the tab and is situated over the frangible seal of the can.

In the exemplary embodiment of the present invention, the wide wing span of the wing tab allows for the printing of information in the form of advertisements, logos, website addresses, motivational messages, contest codes/rules, graphic designs and other such information for dissemination to the consumer and the public in general. In this embodiment of the invention, the wing tab, depending on the particular can end on which it is affixed, offers an area roughly 40-45 mm wide by 20-25 mm high for logos or messages on both the top and bottom surfaces of the tab. In this embodiment of the invention, laser cutouts or etchings may also be placed on the wingspan of the tab.

In yet another embodiment of the present invention, the wing tab can typically be dislocated from the can with 3 repeated motions front to back in order to fatigue the aluminum along the axial lines or the fastening tongue that connects it to the central rivet. The wing tab then easily separates from the container and can be saved to preserve the advertisements, logos, or other messages for later review or to redeem the tab for a prize associated with the advertisement or logo. In this embodiment of the wing tab, the compact size of the tab with its smooth edges is appealing to consumers and retailers because of the ease with which it can be inserted into a garment pocket or stored in the retailer's cash register.

In all embodiments of the wing tab of the present invention, the outer edge of the wing tab is recessed approximately 4-6 mm from the outer edge of the can rim so that the tab does not interfere with the stacking of the cans.

In the summary of the invention thus provided and in the specification in general, an embodiment is an example or implementation of the invention as conceptualized and therefore the various references to "an exemplary embodiment," "an embodiment," "yet another embodiment" or "related embodiment" do not necessarily all relate to the same embodiment of the invention. Rather, these references to the various embodiments mean that a particular structure, feature, or characteristic described in connection with an embodiment is included in at least some embodiments, but not necessarily all embodiments of the invention. For further clarity, although various features of the invention may be described in the context of a single embodiment, the features may also be provided separately or in any suitable combination. Conversely, although the invention may be described herein in the context of separate embodiments for clarity, the invention may also be implemented in a single embodiment.

In general, the features and advantages of the various embodiments of the invention as described in the summary of the invention will be further appreciated and become obvious to one skilled in the art when viewed in conjunction with the accompanying drawings, detailed description of the invention and the appended claims.

DETAILED DESCRIPTION OF THE INVENTION

The present invention is an improvement over the can pull tabs in the prior art. The can pull tab of the present invention has a wide wing-shaped design resembling the general shape of a bat with outstretched wings. The seamless construction of the wings is aesthetically pleasing and ergonomically practical in its use as a can pull tab. The wide surface area of the tab permits the printing and display of advertisements, marketing messages, logos and other promotional material both on the top and bottom surfaces of the tab.

Figure 1:
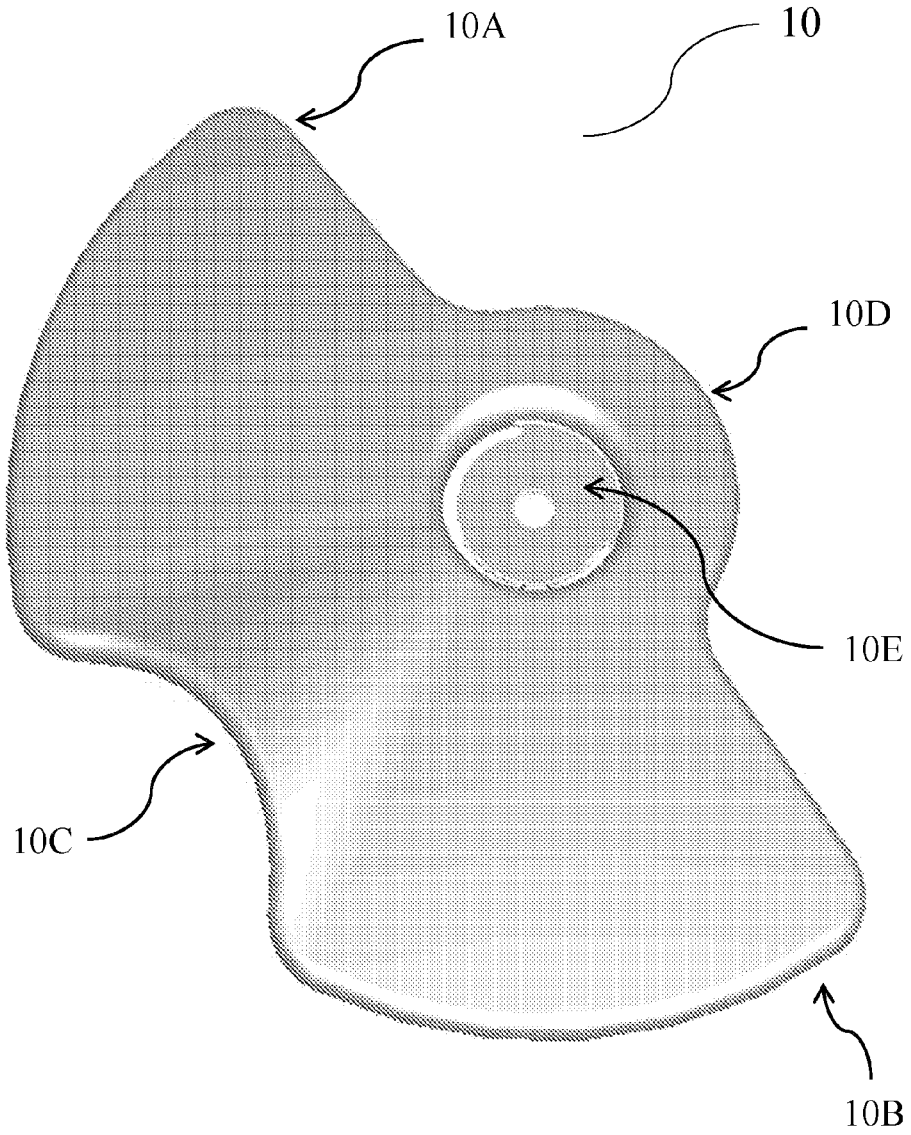
FIG. 1 is a plan view of the wing tab of the present invention.

Referring now to the figures, more particularly, FIG. 1 a plan view of the wing pull tab 10 outside a can is shown to illustrate its general wing-shaped design and the critical functional parts that differentiate the tab from can pull tabs in the prior art. In this figure, the seamless wing construction of the wing pull tab 10 can be seen comprised of a right wing 10A and a left wing 10B with a middle U-shaped curved indent 10C representing the lift end disposed in the center of the total wingspan of the wing tab 10. The lift end 10C is raised within a few millimeters from the can surface to allow for the insertion of a finger of any size and actuate the nose end 10D of the tab to exert downward pressure on the frangible can end seal to open the can to consume the beverage contained in it. The curvilinear U-shaped lift end 10C is also designed to fit over the septum of the nose to permit a person to drink directly from the can without tilting their head back to pour the beverage into their mouth. In this figure of the wing pull tab 10 a fastening tongue and hinge 10E is disposed centrally within the nose end 10D for the securement of the wing pull tab 10 to the central rivet of the can.

Figure 2:
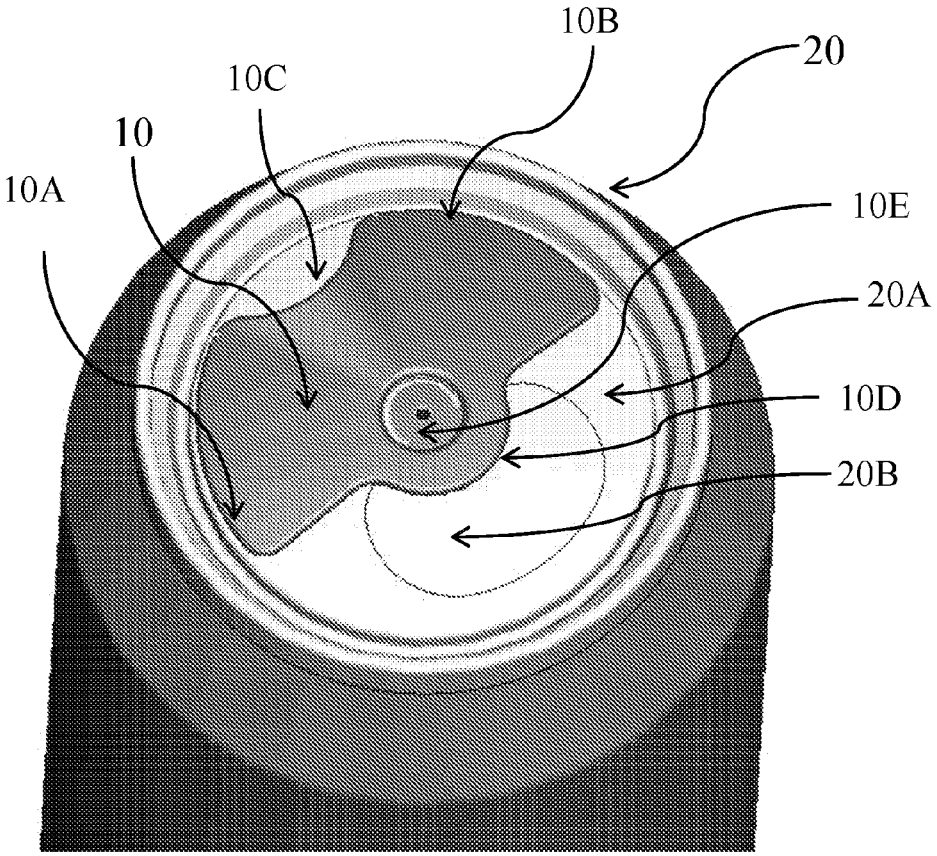
FIG. 2 is a perspective view of the wing tab of the present invention as it would be disposed on the beverage can end.

FIG. 2 is a perspective view of the wing pull tab 10 disposed over the can 20 and attached to the central rivet on the can end surface 20A through the central fastening tongue and hinge 10E of wing tab 10. The perspective view of this figure depicts the disposition of the wing tab 10 in a manner that leaves sufficient space between the outermost edges of the tab wings 10A and 10B and the outer edge of the can 20 rim to allow for the stacking of the cans. The wing pull tab 10 is also disposed in a manner that leaves sufficient space between the lift end 10C of wing tab 10 and the can 20 rim to permit the insertion of a finger through the elevated curved lift end 10C to start the actuation process through the nose end 10D and break the frangible can seal 20B.

Figure 3:
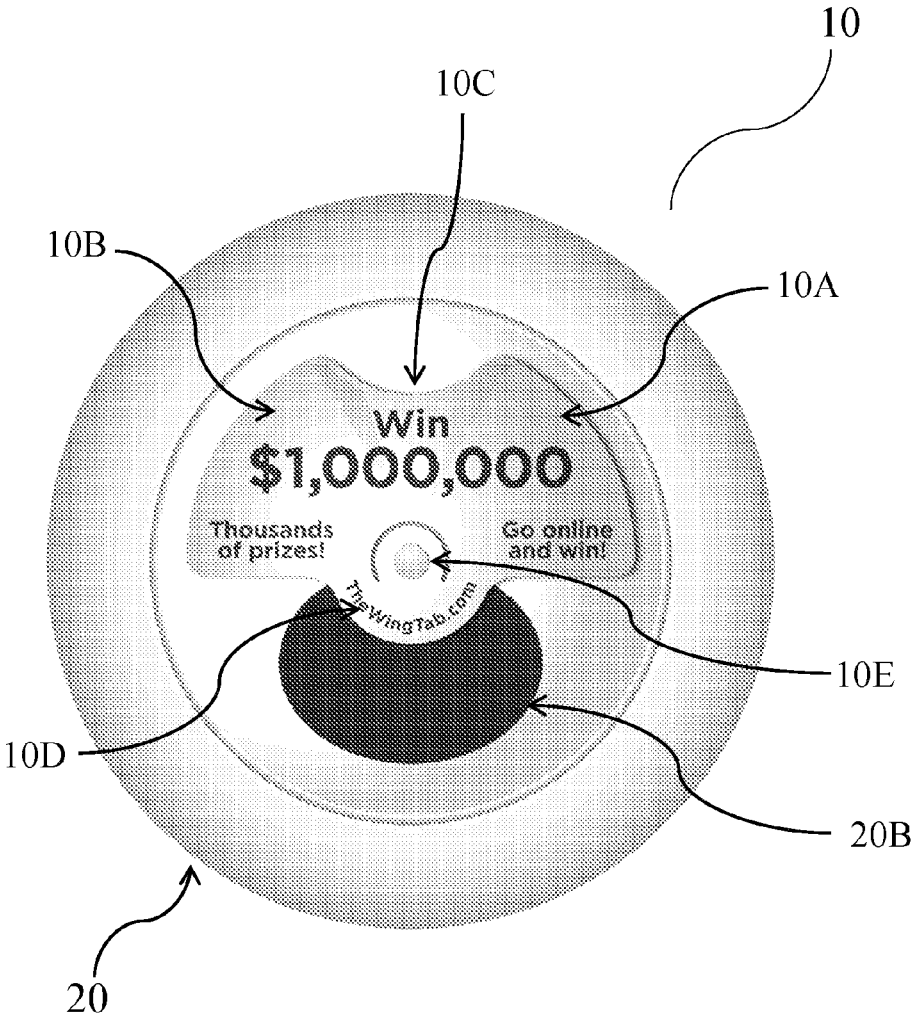
FIG. 3 is a perspective view of an exemplary embodiment of the wing tab depicting the shape and size of the tab and its potential to accommodate information, art or logos on its surface.

FIG. 3 is a perspective view of an exemplary embodiment of the wing pull tab 10 and its disposition over the can 20 end. The figure illustrates a realistic depiction of the manner in which a marketing message is printed over the wide wingspan of the wing pull tab of the present invention. The figure shows the size, breadth and positioning of the wing pull tab with its wings 10A and 10B and lift end tab 10C, nose end 10D and central fastening hinge 10E over can 20. In this figure, the frangible can seal 20B is depicted as having been broken exposing the hole in the can end with the wing pull tab still attached to the can mouth. The wing pull tab can be removed either before or after the beverage is consumed and stored in a pocket for redemption of prizes or to save the marketing message.

The foregoing description of the present invention through its figures and the various embodiments should not be construed to limit the scope of the invention. It should be understood and obvious to one skilled in the art that the embodiments of the invention thus described may be further modified without departing from the spirit and scope of the invention as set forth in the claims that follow.

What is claimed is:

1. A pull tab comprising:

a first projection configured to linearly extending from a central fastening rivet of a container to a first point adjacent to a circumference of the container;

a second projection configured to linearly extending from the central fastening rivet of the container to a second point adjacent to the circumference of the container;

an arc configured to extend from the first point adjacent to the circumference of the container to the second point adjacent to the circumference of the container, the arc including a concave indention disposed at a peak of the arc, wherein the concave indentation is elevated from the surface of the body, and the concave indention comprises a curved top surface and a curved front surface;

a body defined by the first projection, the second projection, the body being configured to cover an entire surface of the container disposed within a perimeter of the body, wherein information is configured to be disposed on a side of the body positioned adjacent to the surface of the container, the body being comprised of a continuous surface within the perimeter of the body; and a fastener coupled to the body and the central fastening rivet, the fastener being configured to secure the body to the container, wherein the curved top surface of the arc extends from the peak of the arc to the fastener.

2. The pull tab of claim 1, wherein the pull tab is configured to be disposed on top of the container, wherein the container is a beverage can.

3. The pull tab of claim 1, wherein the concave indentation is a u-shaped indentation comprising a curved outer surface.

4. The pull tab of claim 1, wherein a width of the body is at least 33 mm.

5. The pull tab of claim 1, wherein the concave indentation is elevated from the surface of the body.

6. The pull tab of claim 1, wherein the first and second points are disposed at least 4 mm from an outer rim of the container.

7. The pull tab of claim 1, wherein the pull tab is removable coupled to the container via the fastener.

8. The pull tab of claim 1, wherein the first projection and the second projection comprise a chord across the surface of the container.

9. The pull tab of claim 1, wherein the concave indentation is configured to receive a septa of a nose to enable a person to drink from the container if the body is coupled to the container.

10. The pull tab of claim 1, wherein the first point and the second point are disposed at a position to leave space for a second container to be stacked on top of the container.

11. A method comprising:

creating a body of a pull tab, the body of the pull tab including a first projection configured to linearly extend from a central fastening rivet of a container to a first point adjacent to a circumference of the container, the body including a second projection configured to linearly extend from the central fastening rivet of the container to a second point adjacent to the circumference of the container, the body including an arc configured to extend from the first point adjacent to the circumference of the container to the second point adjacent to the circumference of the container, the arc including a concave indention disposed at a peak of the arc, wherein the concave indentation is elevated from the surface of the body, and the concave indention comprises a curved top surface and a curved front surface, wherein the body is a flat surface defined by the first projection, the second projection, and the arc and the body is configured to cover an entire surface of the container disposed within the perimeter of the body, the body being comprised of a continuous surface within the perimeter of the body, and the curved top surface of the arc extends from the peak of the arc to the central fastening rivet;

disposing information on a side of the body positioned adjacent to a surface of the container.

12. The method of claim 11, comprising:

coupling the body to the container via a fastener.

13. The method of claim 12, further comprising:

detaching the body from the container along an axis associated with the chord.

14. The method of claim 11, wherein the body is a pull tab configured to be disposed on top of the container, wherein the container is a beverage can.

15. The method of claim 11, wherein the concave indentation is a u-shaped indentation comprising a curved outer surface.

16. The method of claim 11, wherein a width of the body is at least 33 mm.

17. The method of claim 11, wherein the concave indentation is elevated from the surface of the body.

18. The method of claim 11, wherein the first and second points are disposed at least 4 mm from an outer rim of the container.

19. The method of claim 11, wherein the first projection and the second projection comprise a chord across the surface of the container.

20. The method of claim 11, wherein the first point and the second point are disposed at a position to leave space for a second container to be stacked on top of the container.

* * * * *